United States Patent [19]

Mercer

[11] Patent Number: 4,841,578

[45] Date of Patent: Jun. 27, 1989

[54] SANITIZER FOR RECREATIONAL VEHICLE WASTE SYSTEM

[76] Inventor: Al Mercer, Post Office Box 531, Jacumba, Calif. 92034

[21] Appl. No.: 176,618

[22] Filed: Mar. 28, 1988

Related U.S. Application Data

[63] Continuation-in-part of Ser. No. 920,111, Oct. 7, 1986.

[51] Int. Cl.[4] ..... E03D 9/02

[52] U.S. Cl. ..... 4/224; 4/225

[58] Field of Search ..... 4/222–226, 4/232, 370, 321

[56] References Cited

U.S. PATENT DOCUMENTS

| | | | |
|---|---|---|---|
| 618,349 | 1/1899 | Heany | 4/225 |
| 853,434 | 5/1907 | Blackmore | 4/222 |
| 1,110,620 | 9/1914 | Fraser | 4/224 |
| 2,397,677 | 4/1946 | MacGlashan | 4/224 |
| 3,320,621 | 5/1967 | Vita | 4/222 X |
| 4,262,372 | 4/1981 | Ryder | 4/222 |
| 4,516,281 | 5/1985 | MacPherson et al. | 4/222 X |

*Primary Examiner*—Charles E. Phillips
*Attorney, Agent, or Firm*—Ralph S. Branscomb

[57] ABSTRACT

A sanitizer for recreational vehicles is interposed between the toilet flush valve and the toilet itself. It utilizes an upright canister which maintains a substantial air pocket to prevent back-flow, there being a charge of sanitizing chemicals in the bottom of the canister which dissolve slowly in the water that is introduced into the canister to flush the toilet. An inverted U-shaped tube introduces the fresh water into the canister, and by virtue of a vertically, downwardly extended length of the U-shaped tube which extends down into the canister, the sloshing of water into a downhill portion of the fresh water system is inhibited.

The system overcomes the prior art arrangement in which a charge of chemicals is dumped into the holding tank with every tank flush, and it adds the anti-back-flow or anti-reverse-syphon protection of a three-stage prophylactic.

4 Claims, 1 Drawing Sheet

FIG. 1
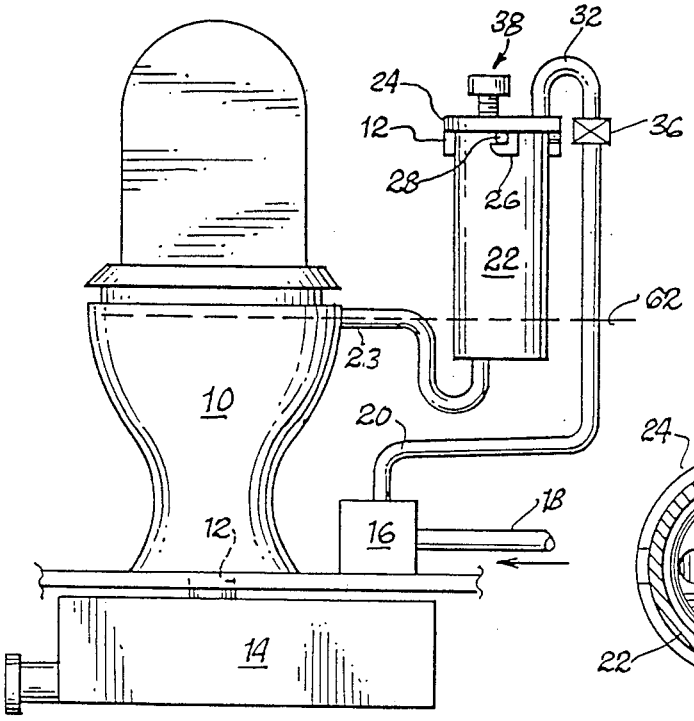
FIG. 4
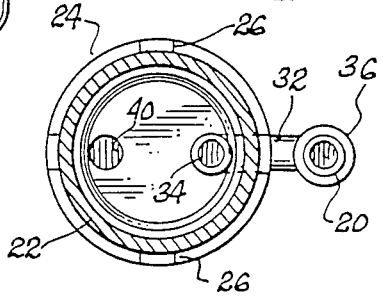
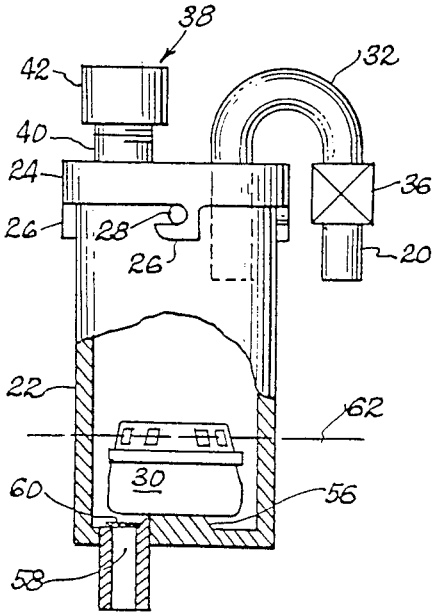
FIG. 2
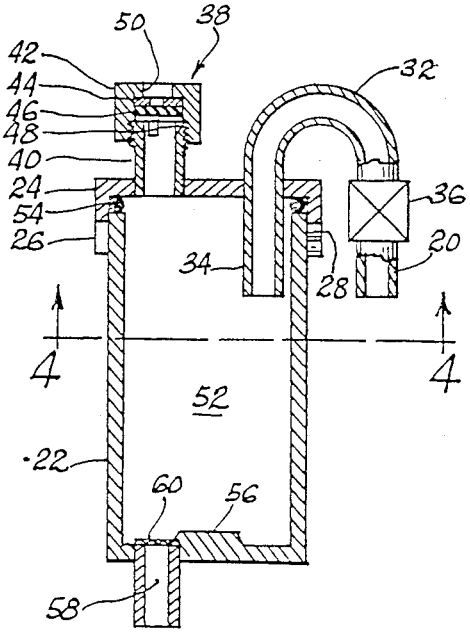
FIG. 3

SANITIZER FOR RECREATIONAL VEHICLE WASTE SYSTEM

The instant invention is a continuation-in-part application of application Ser. No. 06/920,111, filed 10/17/86, by AL MERCER on a TOILET SANITIZER.

BACKGROUND OF THE INVENTION

Conventional marine pleasure craft and recreational vehicles have self-contained bathrooms and sewage storage systems which conduct their waste water to larger holding tanks in RV parks, dock facilities and other similar places. There are available pre-portioned chemical powders which are to be used by adding them directly into the holding tanks of the vehicles to thus sanitize and deodorize them. In the case of recreational vehicles for example, every time the vehicle is taken out and used, one of these pre-portioned doses of chemicals is added to the holding tank, and of course, is flushed out of the holding tank along with the waste when the tank is dumped.

This system of having chemicals introduced into the holding tank has certain disadvantages. First, an entire measure of the sanitizing chemicals must be used every time a vehicle is taken out and the tank subsequently dumped. Thus, even though the outing may only be for a day of two, the same amount of chemicals is used to sanitize the tank as would be necessary for a more extended trip when the entire tank is filled.

Additionally, besides the expense of requiring more chemical than is really needed, there is the nuisance of having to put the chemical in the tank, and the possibility that one might forget to add the chemicals, causing a fouling of the interior of the holding tank.

Prior art tanks are provided with required anti-back-flow safety provisions to prevent the chemicals from moving upstream in the system and entering the fresh water tank. The anti-back-flow protection also prevents waste water from the toilet from entering, and then moving up through, the fresh water inlet. However, in some cases it is questionable whether these systems are effective. This is especially true in the common situation in which additive chemicals are downstream of the fresh water supply but are maintained at the same pressure, being upstream of the toilet flush valve. Since there is no steep pressure gradient to overcome, irrespective of check valves and other safety precautions there is a heightened possibility of system failure and chemical back-flow There is a need, therefore, for a simple, add-on unit which is readily connectable to existing systems to automatically treat incoming flushing water as it is dumped into the holding tank, so that pre-measure doses, added as water is used, sanitizes both the toilet and the holding tank, and lasts for many uses, without requiring any action of thinking on the part of the RV owners.

SUMMARY OF THE INVENTION

The present invention is a simple add-on unit which fulfills the above-stated need, and connects directly into the fresh water flushing system with a minimum of mounting procedures.

The unit comprises a canister which houses a slow-release chemical cartridge, the chemicals being sanitizing and deodorizing substances.

The canister includes a removable cap for replacing the cartridge. The cap also mounts a vacuum breaker valve, as well as the fresh water supply line which also incorporates a check valve to positively prevent back-flow from within the canister into the fresh water system.

The unit can be installed at the point of manufacture very effectively, although the described embodiment is a retro-fit unit which can simply be installed on existing pleasure craft or recreational vehicles by adapting the existing tubing and fittings.

Use of the canister will cause waste water to be automatically treated over an extended period of time, which the amount of treating chemicals being proportional to the usage of the system as another dose is added to the holding tank every time the toilet is flushed.

In addition to the check valve, the back-flow is prevented by virtue of the fact that the canister which mixes in the sanitizing chemical is downstream of the toilet flush valve, and operates at ambient pressure rather than at the pressurized fresh water tank pressure. Additionally, there is an air pocket in the canister which remains at all times. A vacuum breaker valve recharges the air pocket when it is reduced below its normal size. Thus, the system has the check valve, the low-pressure operation of the chemical canister, and the air pocket between the out-flow from the canister and the in-flow of fresh water into the canister, all to oppose back-flow and prevent accidental seepage of chemicals or sewage into the fresh water supply at all times.

BRIEF DESCRIPTION OF THE DRAWINGS

FIG. 1 is a front elevation view of a toilet mounted above a holding tank with the invention connected;

FIG. 2 is an enlarged side view of the unit with portions cut away showing the replaceable chemical cartridge;

FIG. 3 is a vertical section of the unit; and,

FIG. 4 is a horizontal section taken lines 4—4 of FIG. 3.

DETAILED DESCRIPTION OF THE PREFERRED EMBODIMENT

A typical installation is shown in FIG. 1, in which a commode 10 is mounted in a recreational vehicle, and flushes through an opening 12 into a holding tank 14. The flush valve 16 is connected to a fresh water supply 18, and ordinarily the pipe 20 which exits the flush valve would enter the toilet at 23, delivering the flushing water around rim outlets at the top of the toilet.

However, with the instant invention in place, the line 20 which previously connect to the inlet 23 is severed, and the invention is installed with threaded couplings, or other suitable connections, to the cut ends so that water coming from the flush valve 16 up through the pipe 20 now passes through the invention before it enters the rim of the toilet.

The invention constitutes a main canister 22 with a twist-off removable cap 24. The cap is held on by means of integrally molded hooks 26 which engage the radial pegs 28 extending from the canister. A slight rotation of the cap will disengage the hooks from the peg and permit removal of the cap from the canister for replacement of the cartridge 30, shown in FIG. 2.

Mounted to the canister cap is an inverted U-shaped tube 32, which has a length 34 which extends well down inside the canister. The other end of the U-shaped tube connects to the pipe or tube 20, preferably through a check valve 36 which could be mounted to the U-shaped tube, or to the tube 20. Although not shown, in ordinary installation there would be a junction between the part of the tube 20 which was cut to insert the canister, and the part which was added with the canister. If the tube 20 is flexible, the joint need not be separable because the cap 24 can be easily removed from the canister and the tube 20 will bend to accommodate the removal.

Again referring to the cap 24, it also mounts a vacuum breaker valve 38 comprising an upright nipple 40 and vacuum breaker cap 42, which cap captures a washer 44 and a flapper disc 46 between the vacuum breaker cap and the top of the nipple. The top of the nipple is cut away at 48 so that when the flapper valve rests on the top of the nipple, air can pass around the flapper valve so that any vacuum within the canister will be broken. When the flapper disc is pushed up, it blocks against the washer, sealing the vent 50 in the vacuum breaker cap to prevent air from escaping from the internal, hermetically sealed chamber 52 of the canister. Although it is hard to see, the groves 48 may also extend along inside the cap 24, or the flapper disc 46 may of reduced diameter, so that air may pass around the flapper disc. As an alternative to this general style of check valve, the flapper could be bonded at one edge at its top to the washer 44, so that it will remain adjacent the washer unless there is a draw from within the canister, at which point it will be deflected downwardly, to permit entry of air through opening 50.

Actually, the vacuum breaker 38 could probably just as easily be a two-way vent, but then it would not technically be a "vacuum breaker valve," which may be necessary to meet certain code requirements in various states.

The cap is sealed against the top of the canister with an O-ring 54, and the bottom of the canister defines a short boss 56, and an outlet 58 covered by a screen 60. When the cartridge 30 of sanitizing chemical is placed in the canister, as shown in FIG. 2, it is spaced by the boss above the screened outlet to permit water with the sanitizing fluid in it to pass down through the outlet into the tube 23 to flush the toilet.

The cartridge 30 could be of any configuration, and could be a packet or cake of water soluble sanitizing chemicals. Chemicals of this type work on the principle that they dissolve partially until the concentration of dissolved chemical reaches a certain level in the ambient fluid, and the chemicals will not dissolve further, until the concentration is reduced. This permits one charge of chemicals to be used for many different flush cycles until it is finally used up. The cartridge as shown, which is not part of the invention, would ventilate through holes in the top to disperse dissolved chemicals into the main body of water within the canister between flushes.

The instant invention is inherently designed to make backflow virtually impossible. The first way in which this is done is to design the unit so that it is downstream of the flush valve 16. Because of this it operates at atmospheric pressure, and not at the higher pressure that the water in the water system achieves. For this reason, any liquid in the canister which back-flows would have to overcome the pressure gradient between atmospheric pressure and the pressure in the fresh water supply, which would be impossible in most instances.

Additionally, rather than having a continuous stream of liquid from the fresh water supply down to the toilet in the pipe 23, the invention maintains a large air pocket within the chamber 52. To understand why the air pocket stays in place, a typical flushing cycle will be discussed. In its quiescent state, liquid inside the canister will be maintained at the level 62 of the outlets inside the rim of commode by the U-trap located in line 23. If the recreational vehicle is moving, the sloshing from side-to-side may reduce the level below that indicated at 62, which will not interfere with the operation of the unit.

When the unit is flushed, fresh water rapidly enters the canister and tries to fill it. However, because the vacuum breaker valve 38 will not allow air to escape through it, the water inside the canister will be forced out into the toilet approximately as fast as it is introduced into the canister from the pipe 20, up through the U-shaped tube 32.

If there is any obstacle in the line 23 or in the outlets into the upper rim of the toilet, the pressure developed inside the canister will tend to force the obstacles out of the path. If there are no obstacles, gravity and a slight pressure within the canister will drain the level in the canister back to level 62. As the water in the canister drops, a slight inertia will develop, and it will result in pulling air in through the vacuum breaker valve 38 after the flush valve is shut off and most of the water has drained into the toilet. If the air pocket within the canister, by reason of the air dissolving into the water or for some other reason, begins to diminish, the water level inside the canister would rise above the level 62, and gravity would reduce the level again and pull air in through the vacuum breaker valve again.

For these reasons, it can be seen that a substantial air pocket will exist within the canister between the level 62 and the top of the canister. When not flushing, air will also fill the inlet tube 34. Because of the extent of the inlet tube 34, any water with the sanitizing chemical in it which happens to slosh up against the tube 34 will not drain back into the fresh water supply because it would have to climb up the tube 32 and around the bend, before it even got to the check valve 36, which serves as a secondary safety.

Therefore, the invention is triply protected against backflow into the fresh water system. First, a large air pocket is maintained inside the canister by its geometrical configuration and by action of the vacuum breaker valve.

Second, the U-shaped tube 32, which extends down inside the canister, will prevent water with the sanitation chemical from flowing up and back into the fresh water supply.

Third, the check valve 36 will also serve this function. Of course, the flush valve 16 will itself stop backflow, so in actuality there are four back-flow deterrents.

For these reasons, not only is the instant invention a convenience item, it is also a safety item. By addition of the unit, it actually increases, rather than decreases, the buffer against back-flow of the system.

The unit as described and illustrated herein is economical to manufacture and utilizes off-the-shelf components for the most part so that no molds are required in the manufacture. It is also a major advantage of the unit that it is easily retrofitted on existing boats and RVs, as well as being very adaptable for installation at the point of manufacture. The unit provides a greatly simplified method over the previous tedious, inefficient method of adding pre-portioned chemicals directly to the holding tank before it is drained irrespective of the volume of waste within he tank. Additionally, because the system flushes water straight through the toilet, manual cleaning of the toilet will be required less frequently than under the old method, in which the chemical bypassed the toilet and went directly into the holding tank. Thus, the instant system is more economical, less trouble, and less subject to error by omission than the existing system.

I claim:

1. A chemical dispensing system for a waste management system having a toilet, a holding tank for receiving water from the toilet, and a fresh water flush system including a flush valve for introducing fresh flushing water into a flow channel inside the upper rim of said toilet, said chemical dispensing system comprising:

a. an upright canister downstream of said flush valve and having a lower body portion and a canister cap, and defining a hermetically sealed internal chamber and having an outlet in the chamber bottom emptying into said toilet through a U-trap, such that said U-trap will establish a solution level in said canister and an inlet connected to said fresh water flushing system via said flush valve, the substantial portion of said canister being above said flow channel and said inlet being substantially above said outlet so an air pocket is captured in said canister above said solution;

b. a chemical cartridge housed in said internal chamber and containing at least partially water soluble chemicals; and, c. a vacuum breaker valve located in said canister above said solution level to allow air to enter but prevent air from escaping said canister such that solution inside said canister will be forced out of said canister through said trap approximately as fast as water is introduced from said flush valve until the solution drops to said solution level established by said trap.

2. Structure according to claim 1 wherein said vacuum breaker extends up from said cap and comprises a threaded nipple integral with and upwardly extended from said cap, a resilient flapper disc atop said nipple, a washer atop said flapper disc, and a vented vacuum breaker cap threaded into said nipple capturing said flapper disc and washer between said vacuum breaker cap and said nipple, and means permitting air to pass around said flapper disc and into said nipple when ambient air pressure exceeds pressure in said air chamber.

3. Structure according to claim 1 wherein said inlet connects to said fresh water supply through an inverted U-shaped tube, one leg of which enters said canister through the cap thereof, and the other leg connecting to the fresh water supply.

4. Structure according to claim 3 wherein said chamber has a floor defining an upright boss for supporting said cartridge, and said outlet in said chamber is disposed alongside said boss and covered by a screen.

5. Structure according to claim 3 wherein said the body of said canister has a plurality of short radially-extended pegs spaced around the circumference thereof near the upper edge, and said canister cap has a plurality of integral hooks for engaging said pegs to retain said canister cap on said canister body when said canister cap is twisted thereon.

* * * * *